US010463898B1

(12) United States Patent
Du Plessis

(10) Patent No.: US 10,463,898 B1
(45) Date of Patent: Nov. 5, 2019

(54) EXPANDABLE FIRE-FIGHTING FOAM SYSTEM, COMPOSITION, AND METHOD OF MANUFACTURE

(71) Applicant: Jaco Du Plessis, League City, TX (US)

(72) Inventor: Jaco Du Plessis, League City, TX (US)

( * ) Notice: Subject to any disclaimer, the term of this patent is extended or adjusted under 35 U.S.C. 154(b) by 0 days.

(21) Appl. No.: 16/040,301

(22) Filed: Jul. 19, 2018

(51) Int. Cl.

| | |
|---|---|
| ***A62C 5/02*** | (2006.01) |
| ***A62C 13/62*** | (2006.01) |
| ***A62C 13/64*** | (2006.01) |
| ***A62C 5/00*** | (2006.01) |
| ***A62C 13/00*** | (2006.01) |

(52) U.S. Cl.
CPC ..... *A62C 5/022* (2013.01); *A62C 5/002* (2013.01); *A62C 13/003* (2013.01); *A62C 13/62* (2013.01); *A62C 13/64* (2013.01)

(58) Field of Classification Search
None
See application file for complete search history.

(56) References Cited

U.S. PATENT DOCUMENTS

| | | | | | |
|---|---|---|---|---|---|
| 1,260,818 | A | | 3/1918 | Schultz | |
| 1,335,394 | A | | 3/1920 | Rustige | |
| 1,377,431 | A | | 5/1921 | Pfeil | |
| 1,674,427 | A | | 6/1928 | Freygang | |
| 2,563,300 | A | | 8/1951 | Leonard | |
| 3,293,861 | A | | 12/1966 | Hinde | |
| 3,342,271 | A | | 9/1967 | Anthony | |
| 3,529,670 | A | | 9/1970 | Herbline | |
| 3,592,269 | A | | 7/1971 | Stults | |
| 3,709,302 | A | * | 1/1973 | Stults | A62C 5/022 169/9 |
| 3,727,841 | A | | 4/1973 | Hengesbach | |
| 3,750,754 | A | | 8/1973 | Stults | |
| 3,876,010 | A | | 4/1975 | Blomquist et al. | |
| 4,291,769 | A | | 9/1981 | Muller | |
| 4,951,754 | A | | 8/1990 | Solheim | |
| 5,031,834 | A | | 7/1991 | Simpson | |
| 5,305,957 | A | | 4/1994 | Szocs | |
| 5,409,067 | A | | 4/1995 | Esposito et al. | |
| 5,573,068 | A | | 11/1996 | Sharma et al. | |
| 5,623,995 | A | * | 4/1997 | Smagac | A62C 5/02 169/13 |
| 5,655,579 | A | * | 8/1997 | Prescott | A62C 37/50 141/114 |
| 5,664,631 | A | | 9/1997 | Szocs | |
| 5,806,602 | A | | 9/1998 | Ros | |
| 6,116,464 | A | * | 9/2000 | Sanders | F17C 1/00 141/114 |
| 6,155,351 | A | | 12/2000 | Breedlove et al. | |
| 8,109,341 | B1 | | 2/2012 | Szocs | |
| 2001/0042627 | A1 | * | 11/2001 | Carrier | A62C 5/02 169/24 |
| 2003/0168225 | A1 | * | 9/2003 | Denne | A62C 13/22 169/46 |
| 2013/0206428 | A1 | * | 8/2013 | Phillips | A62C 3/065 169/16 |

FOREIGN PATENT DOCUMENTS

| | | | |
|---|---|---|---|
| CH | 682457 | A5 | 9/1993 |
| DE | 837054 | C | 4/1952 |
| DE | 872316 | C | 3/1953 |
| DE | 908940 | C | 7/1954 |
| EP | 0774278 | A2 | 5/1997 |
| ES | 2123464 | A1 | 1/1999 |
| FR | 960330 | A | 4/1950 |
| GB | 1080111 | A | 8/1967 |
| GB | 2265085 | A | 3/1992 |
| WO | WO9511725 | A1 | 5/1995 |
| WO | WO9725105 | A1 | 7/1997 |

OTHER PUBLICATIONS

International search report and written opinion for PCT/US2019/040881, dated Aug. 19, 2019, 7 pages.

* cited by examiner

*Primary Examiner* — Joseph D Anthony
(74) *Attorney, Agent, or Firm* — Law Office of Sam Sokhansanj PLLC

(57) ABSTRACT

A method of manufacturing a self-expanding fire-fighting foam solution is disclosed. Here, the method can include purging air from a container, wherein the purging is performed via flowing an inert gas into the container, such that substantially inert environment is created within the container. In addition, the method can further include dispensing or filling a pre-determined amount of foam concentrate into a container, dispensing or filling a pre-determined amount of water into the container, and mixing the foam concentrate and water within the container, wherein the mixed foam and water within the inert container provide the self-expanding fire-fighting foam solution and having a pH ranging from about 6.8 to 7.8 moles per liter.

18 Claims, 5 Drawing Sheets

The graph shows the tank static pressure as a function of time.

The graph shows the tank static pressure as a function of time.

The graph shows the volume flowrate out of the 4" pipeline as a function of time.

EXPANDABLE FIRE-FIGHTING FOAM SYSTEM, COMPOSITION, AND METHOD OF MANUFACTURE

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

The addition of foaming agents to firefighting water streams is known and can be particularly useful for fighting fires, for example, fires in industrial factories, chemical plants, petrochemical plants and petroleum refineries. The use of compressed air firefighting foam requires that air and a foam concentrate be mixed and added at constant proportions to the water stream. When the foam extinguisher solution is delivered, the foam effectively extinguishes the flames of chemical and petroleum fires as well as Class A materials which would otherwise not be effectively extinguished by the application of water alone. In addition, the amount of air added to the water and foam chemical mixture should be properly regulated, i.e. added in the appropriate proportion. The amount of air introduced into the water and foam chemical mixture is controlled to achieve the desired consistency of foam. Firefighting foam that is either too watery due to insufficient air or too dry due to excessive air is less effective at fighting fires and may even be dangerous. The condition in which an excessive amount of air is introduced with the dispensing nozzle closed to create the foam is commonly referred to as air packing or just packing of the hose.

Further, traditional water-based foam systems require complex equipment which typically must work perfectly together in order to manufacture firefighting foam capable of suppressing and extinguishing the type of fires that they were originally developed for. Examples of such equipment include water, foam concentrate, tanks, a pump producing positive pressure and flow, specialty foam control valves, foam proportioners, foam educators, and aeration devices. Further, manufactured foam from such equipment must then also be used immediately and cannot be stored over a period of time.

In addition, in foaming agent compositions, a liquefied or "dry" inert gas is absorbed into a water base or water/foam composition base. Generally, foaming compositions or water/foam mixtures with any type of liquefied inert gas can lower the pH value of such foaming composition. In addition, it is also generally known that traditional foam/water emulsification in bladder tanks can go bad after a period of time due to the presence of oxygen in such containment areas, which can further result in fungal growth that can take place.

Hence, what is needed is a self-expanding foaming composition that is generated in an inert environment and having an increased pH value that is capable of self-expanding in large volumes, less susceptible to fungal growth within a pressure vessel, can extinguish fire in less time, can be stored for prolonged periods of time without degradation, operate as a stand-alone unit, and is cost-effective to manufacture.

BRIEF SUMMARY

In one aspect of the disclosure described herein, a self-expanding or expandable fire-fighting foaming composition, solution, formulation, system, and method of manufacture is disclosed that can be generated in an inert environment and having an increased pH value that is capable of self-expanding in large volumes, that can be less susceptible to fungal growth within a pressure vessel, can extinguish fire in less time, can be stored for prolonged periods of time without degradation, operate as a stand-alone unit, and can be cost-effective to manufacture, among other advantages. In addition, the fire-fighting foam composition of the disclosure described herein can be fully aspirated, pre-manufactured for immediate usage, and can be stored under pressure and be deployed anywhere it may be required without the need of supplemental water supplies, foam concentrates, and/or foam proportioning equipment. In addition, the self-expanding foam composition of the disclosure described here can have foam expansion ratios ranging from 1:8 up to and including 1:10, depending on the fire hazard of the product and application it is to be designed and used for. Moreover, the fire-fighting foam composition and solution of the disclosure can further be capable of being manufactured at any location with the use of enough potable water to meet the volume capacity of the foam vessel being used for the initial manufacturing/foam generation process. Here, such water can be supplied to the vessel in several different methods including a mobile water tanker or by any other conventional system or equipment as provided for in National Fire Protection Association (NFPA) 11, 13, 15 and 16. Moreover, after the fire fighting foam composition and solution of the disclosure is manufactured, no additional or permanent water supply is needed, and the vessel and accompanying skid of the disclosure can be placed on location at any suitable place desired, wherein a typical skid system of the disclosure may be approximately 8 ft. by 40 ft. In addition, the fire-fighting composition of the disclosure can be used to extinguish both Class A and Class B type fires.

In a further aspect of the disclosure described herein, the fire-fighting composition of the disclosure can have a shelf life of at least 10 years. In addition, the fire-fighting composition and solution includes pH values ranging from 6.8 up to and including 7.8 moles per liter. In addition, the fire-fighting composition is not affected by extreme environmental temperatures. In addition, the fire-fighting foam composition does not require an external energy source such as water pumps and/or external pressure/gas source for its discharge, but rather operates from internal stored energy from within the vessel of the disclosure described herein.

In another aspect of the disclosure described herein, a method of manufacturing a self-expanding fire-fighting foam composition, solution, and formulation is disclosed. Here, the method can include purging air from a container, wherein the purging is performed via flowing an inert gas into the container, such that substantially inert environment is created within the container. The method can further include dispensing a pre-determined amount of foam concentrate into a container, dispensing a pre-determined amount of water into the container, and mixing the foam concentrate and water within the container, wherein the mixed foam and water within the inert container provide the self-expanding fire-fighting foam solution. Here, the foam concentrate can include 1-part foam concentrate (1%) and the water include 99-parts water (99%), or the foam concentrate can be 3-parts foam concentrate (3%) and the water can be 97-parts water (97%), or wherein the foam concentrate can be 6-parts foam concentrate (6%) and the water can be 94-parts water (94%). In addition, the method can further include testing the pH of the mixed foam concentrate and water solution via a test port on the container and adding a pH balancing agent or pH additive to the container. Here, the method can include adding the pH balancing agent or pH additive to the container such that a pH value of 6.8 to 7.8 moles per liter is achieved. Further, the step of purging can further include pressurizing the container with the inert gas to a pressure range of about 250 psig to about 300 psig. In addition, the step of mixing can be performed via a centrifugal pump. Here, the container can be a pressure vessel or pressurized holding tank, wherein the pressure vessel or tank can include about 20% to 25% volume of inert vapor space within in it.

In another aspect of the disclosure described herein, a method of manufacturing a self-expanding fire-fighting foam solution, composition, and formulation is disclosed. Here, the method can include pressurizing a pressure vessel with an inert gas, such that the inert gas purges oxygen from the pressure vessel. The method can further include dispensing, adding, or filling a pre-determined amount of foam concentrate into the pressure vessel, dispensing, adding, or filling a pre-determined amount of water into the pressure vessel, mixing the foam concentrate and water within the container, and dispensing, adding, or filling a pH balancing agent, additive, or buffering agent to the mixed foam concentrate and water within the vessel. Here, the foam concentrate can be comprised of 1-part foam concentrate (1%) and the water can be comprised of 99-parts water (99%), or the foam concentrate can be comprised of 3-part foam concentrate (3%) and water is comprised of 97-parts water (97%), or the foam concentrate can be comprised of 6-part foam concentrate (6%) and the water comprised of 94-parts water (94%). In addition, the method can further include dispensing the pH balancing agent or pH additive to the pressure vessel such that a pH value of 6.8 to 7.8 moles per liter of the mixed foam concentrate and water is achieved. Here, the pH balancing agent, additive, or buffering agent used in the disclosure can include but is not limited to any one or more of: any alkaline material, acetic acid, Buff-10, caustic potash (potassium hydroxoide, KOH), caustic soda (sodium hydroxide, NaOH), citric acid, hydrochloric acid (HCl), lime ($Ca(OH)_2$), magnesium oxide (MgO), and soda ash (sodium carbonate, $Na_2CO_3$), among others. Here, the pressure vessel can be pressurized with the inert gas to a pressure range of about 250 psig to about 300 psig. Further, the inert gas of the disclosure can be any one or more of: carbon dioxide, nitrogen, helium (He), argon (Ar), neon (Ne), krypton (Kr), xenon (Xe), and radon (Rn), and oganesson (Og), among others.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
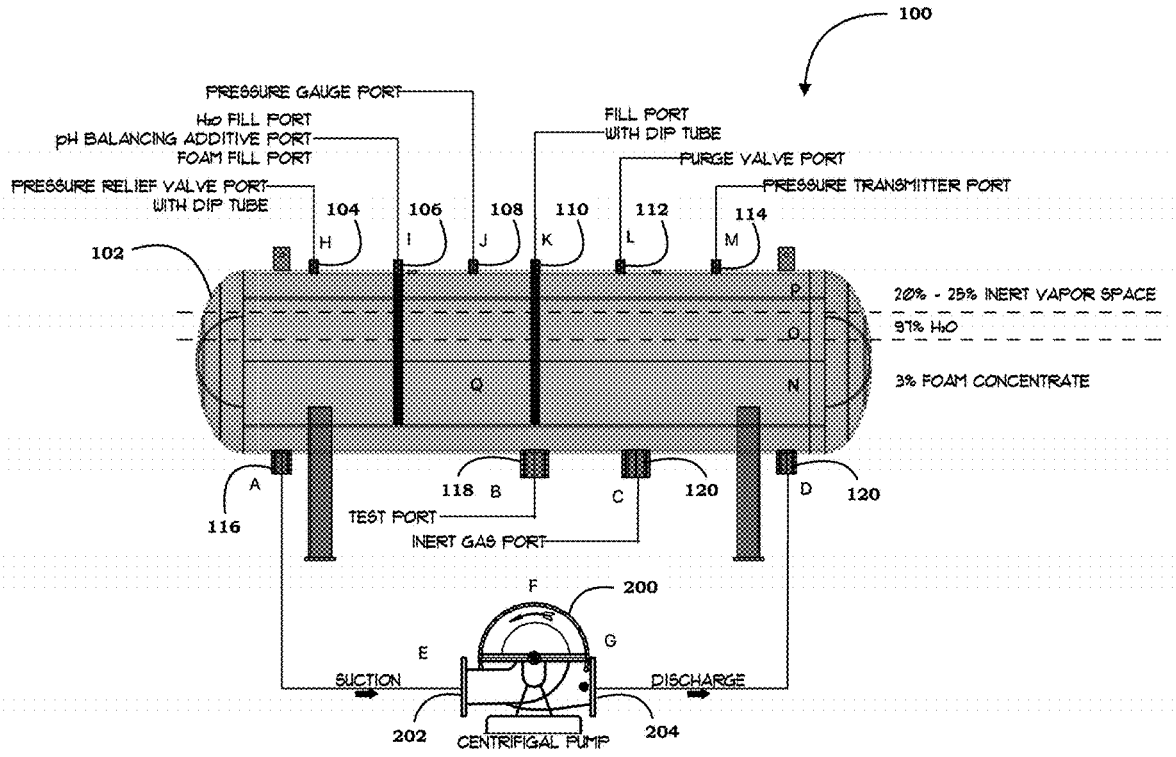
FIG. 1 illustrates a cross-sectional side view for one non-limiting embodiment of the pressure vessel system and method of manufacture of the self-expanding fire-fighting foam solution of the disclosure described herein.

FIG. 1 illustrates one non-limiting embodiment of the disclosure described herein. Here, the fire-fighting foam generating vessel system and method 100 of the disclosure described can include a pressure vessel 102 having a pressure relief valve port 104 which can further include an additive or fill port 106 with a dip tube for water filling, foam concentrate solution filling, and adding a pH balancing additive, control, or buffering agent. In addition, the vessel also includes a pressure gauge port 108, another fill port 110 with a dip tube, a purge valve port 112, a pressure transmitter port 114, a fluid pump outlet port 116, a test port 118, an inert gas port 120, and a fluid pump inlet port 120.

Still referring to FIG. 1, pressure vessel 102 can have a pressure rating ranging from about 100 psig to about 750 psig (6.89 bar-51.71 bar), preferably 200-400 psig (13.8-27.58) bar, and can be connected to a centrifugal fluid pump 200 rated for the design pressures. Pressure vessel 102 can include the outlet port 116 that is connected via a pipeline to an inlet port 202 on the suction side of pump 200. In addition, pressure vessel 102 can further include an inlet port 120 which is further connected via a pipeline to the outlet port 204 G on the discharge side of pump 200. In the current embodiment, pump 200 is configured to form a closed loop system with pressure vessel 102 for mixing the contents of vessel 102, among others. It is contemplated within the scope of the disclosure described herein that there may also multiple other types of pumps in fluid communication with the pressure vessel 102, in addition to or in lieu of pump 200, such as for larger vessels or two or more vessels connected in series or parallel. In addition, pressure vessel 102 may also include other outlet and inlet ports connected to one or more pressure rated valves or pressure monitoring devices. For example, ports 116 and 120 of pressure vessel 102 may include one or more valves, such as one-way or two-way gated valves. Further, pressure vessel 102 may also include ports on its to, sides, or ends to connect to pump 200. In addition, any of the pipelines in fluid communication with the pump and pressure vessel may include one or more pressure gauges and/or pressure/fluid monitoring or testing devices.

Still referring to FIG. 1, the non-return gas purge valve at port 112 can be installed at the top of the pressure vessel 102 but may also be located elsewhere on the pressure vessel if desired. Further, an inert gas medium source and pipeline can be directly connected to vessel 102 via port 120 at or near the bottom region of vessel 102, however, the inert gas source and pipeline may also connect to a port at anywhere else on the vessel, including at pump 200 or its own independent pump (not shown).

In one method of manufacture and generation of the self-expanding fire-fighting composition, solution, and formulation of the disclosure described herein, inert gas can be introduced into vessel 102, which can be empty, such as via port 120, wherein the inert gas can then be released from the top of the vessel via purge valve 112, thereby purging all the oxygenated air from inside the vessel, thus creating an inert environment within vessel 102. For example, during experimental testing, it had been discovered that in a normal state or where an over-pressurization is taking place within the vessel, that without purging the existing oxygenated air, a small amount of oxygen (oxygenated air) is captured inside the vapor space (P) within vessel 102. Here, this oxygenated air is evacuated from the vessel by means of purging the entire system with the inert gas, such as via line and port 120 of vessel 102. Such inert gases (or noble gases) of the disclosure may include but are not limited to carbon dioxide, nitrogen, helium (He), argon (Ar), neon (Ne), krypton (Kr), xenon (Xe), and radon (Rn), oganesson (Og) or any other similar gas having inert properties.

In addition, the percentage (%) volume of the inert gas for the purging of the oxygen can be calculated by taking into consideration the internal area of the pressure vessel, which is equal to or more than the total internal volumetric area of air inside the pressure vessel. Here, the purge valve 112 can be set at a discharge rating of no less than 40 psi (2.76 bar) and further fitted after or with an isolation valve, which can be closed after the purging operation has taken place or has completed. In addition, a pre-mixed, pre-determined, or pre-defined 1%, 3%, or 6% foam concentrate composition, solution, or foaming agent concentrate can then be added and emulsified with water in a separate atmospheric holding tank or directly into the pressure vessel 102 via port 106 at a pre-determined value (%) in relation to the volume of water. For example, the aforementioned 3% foam concentrate composition would contain 3 parts foam concentrate to 97 parts water. Similarly, a 1% foam concentrate solution would contain 1-part foam concentrate to 99 parts water, and a 6% foam concentrate solution would contain 6 parts concentrate to 94 parts water. Here, at this step, it is important that the pH value of this composition be tested at port 118 and a pH balancing, additive, control, or buffering agent be added to the composition to ensure a neutral pH value.

Still referring to the method of manufacture, after the purging operation, water can then be pumped into vessel 102 via port 106 under pressure at a rate higher than the purge valve 112 setting and equal to about 75% to 85% of the total vessel capacity, thereby creating a uniform an about 15% to 25% inert vapor space (P) in the top internal section of vessel 102. In addition, while the centrifugal mixing pump 200 is engaged and in operation, liquefied inert gas can then be added to the composition within vessel 102 via port 120 or provided at the suction 202 or discharge 204 side of the pump or directly via a dedicated port 112. The aforementioned process can then continue until full saturation has taken place within vessel 102 per Henry's Law.

Still referring to the method of manufacture, a sample can then be drawn to test the pH value of the composition, solution, and formulation within vessel 102, such as via test port 118 or any other port. Depending on the results of the pH test, any type of pH balancing agent, additive, or buffering agent may then be added to the vessel via port 106 to achieve the desired pH level of the disclosure. For example, the pH balancing agent, additive, or buffering agent used in the current embodiment of the disclosure is preferably caustic soda, but can be any one or more of an alkaline material, sodium bicarbonate, acetic acid, Buff-10, caustic potash (potassium hydroxide, KOH), caustic soda (sodium hydroxide, NaOH), citric acid, hydrochloric acid (HCl), lime ($Ca(OH)_2$), magnesium oxide (MgO), and soda ash (sodium carbonate, $Na_2CO_3$), among others. Further, additional inert gas may be introduced into the vessel, wherein the additional induction of the inert gas through the emulsified water foam composition will result in the saturation of the composition with inert gas below the inert vapor space (P). Here, the over pressurized vapor space (P) and saturated composition creates a net pressure within the vessel, thereby pushing and discharging the entire manufactured and generated self-expanding fire-fighting composition of the disclosure out of the pressure vessel when desired. Here, upon release of the composition from the pressure vessel 102, the rapid propulsion of the fully absorbed fire-fighting composition with the inert gas, causes rapid expansion of the foam composition as it gets introduced to an oxygenated state or when it is exposed to oxygen in the atmosphere.

Here, some advantages of the fire-fighting foam composition of the disclosure described herein can include a foam application rate of 0.25 gpm/ft$^2$, a reduced application/dispense time of about 10 minutes for both Class 1, Class 2, and Class 3 flammables. Further, the vessel system of the disclosure can also include one actuated valve per riser, without the need for bladder or surge tanks, flow control valves, or flow switches. In addition, total duration for extinguishment can be under two (2) minutes.

Computational Fluid Analysis Study

In one experimental computational and simulation study, computational fluid dynamic (CFD) analysis was performed to analyze the fire-fighting foam composition and system of the disclosure described herein. Here, the study was performed to capture and map the characteristics and flow dynamics of fire-fighting foam composition and system of the disclosure described herein. Here, the testing conditions included am ambient temperature of 80 Degrees F., foam composition temperature released into atmosphere at 35 Degrees F., a pH value of 7.2, potable water having 97 parts (97%), foam concentrate having 3 parts (3%), color being light green, and the gas being inert. This analysis was further based on 1000-gallon vessel tank at 250 psig attached to a 300-foot by 4-inch stainless steel pipeline. Further, the CFD analysis included analyzing the system as a two-phase flow model. Further, the study used ANSYS Fluent as the CFD software for this analysis. In addition, the modeling approach was a Eularian/Eularian approach. Here, the preliminary CFD results presented showed that the tank pressure reaches 50 psig at approximately 40 seconds.

Here, the computational study incorporated Henry's Law into the modeling. In particular, Henry's Law constant for $CO_2$ is 29.41 L-atm/mol. With this constant the study found that inside an inert environment of an enclosed pressure vessel with a 25% vapor space, an "oversaturation" takes place at a rate of 2.7% the total volume per pound (lb) at a 3% mixed foam concentrate solution under 250 psig. Here, the constant at 0 psig is 0.15% of the total volume per lb. at a 3% mixed foam concentrate solution. Further, one-gallon of water=8.345 lb, total volume=750 gallons×8.345=6,258.75 lb, the total gas ($CO_2$) absorption over 6,258.75 lb=168.7 lb, thus: 168.7÷6,258.75×100=2.695%~2.7%. Further, the 3% concentrate composition was tested by Ansul® proving that the density is almost equal to water shown with the following: Surface tension of 20.68 mN/m; interfacial tension of 1.17 mN/m; density of 0.9992 g/ml; and spreading coefficient of 3.75. Here, with a variance in gas/water quality, the current solution design is based on a gas absorption rate of 3% at 250 psig/lb with a 3% premixed volume. This base percentage has resulted in a uniformed quality. Further, the inert gas which cannot be taken up in the mixed molecular composition will fill the vapor space and as the product is released to the atmosphere, it will push the remainder out to the atmosphere. The compressed composition of the disclosure described herein will exponentially expand to its 1:10 state with an increased bubble wall thickness. In addition, the mixing and manufacturing process of the self-expanding fire-fighting composition of the disclosure results in a solution with a desirable pH of 6.8 to 7.8 moles/liter.

Figure 2A:
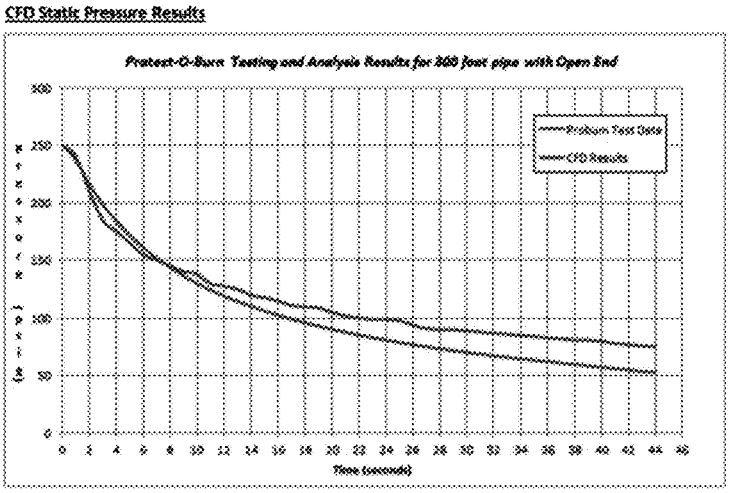
FIGS. 2A-2C illustrate lines charts for various computational fluid analyses of the method and system of the disclosure described herein.
Figure 2B:
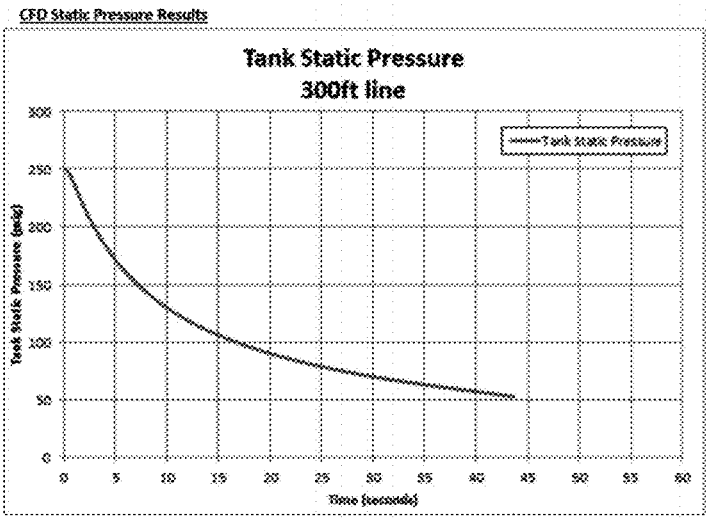
Figure 2C:
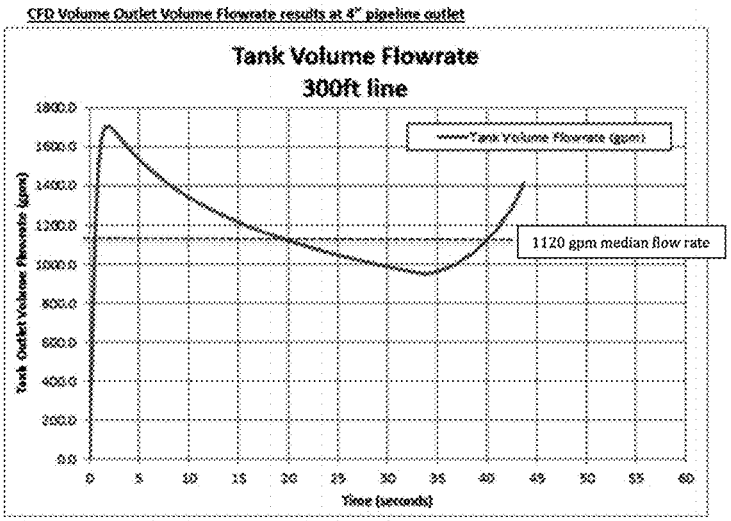

Referring to FIGS. 2A-2C, the results of the CFD study provided several significant values for baseline performance of the fire-fighting foam vessel, system, manufacturing, and composition of the disclosure described herein. There is conclusive evidence that based on the mixing and filling mechanism employed by the disclosure for the manufacturing of the self-expanding fires fighting foam composition into the tanks and for the pressures that were used, the calculated volume of solution will be dispersed from the tank prior to complete pressure decay. In other words, the fire-fighting foam composition of the disclosure will not be left in the tank without pressure to push it out. Here, the fire-fighting composition method of manufacture and system of the disclosure invokes a more aggressive approach in comparison to the conventional prescriptive water-based foam systems. As suggested and allowed by NFPA 11-5.2.5.2.3, higher densities can be used for application rates allowing for a reduction in the duration required. There is a limit however, to that reduction of nothing less than 70%. Given the superior foam solution of the disclosure that is being dispersed immediately from the discharge device, vessel, or a nozzle, and the cooling properties inherit to the foam solution, a much higher rate of heat absorption and vapor suffocation takes place. As such, the faster the foam solution of the disclosure can be delivered and applied, faster extinguishment of flammables are accomplished. In contrast, for a conventional water-based system to perform to this higher level would require maximum sized fire water pumps and stored water volumes several times their minimum required size. Here, the method and system of the disclosure can achieve this higher level of application rate utilizing an ASME pressure vessel charged to a normal static pressure with a range of about 250 psig to 300 psig. The CFD data below demonstrates how this higher application rate dispenses 1,000 gallons of the fire-fighting solution of the disclosure through 300 feet of 4-inch pipe thru a 4-inch open end orifice within 44 seconds. Using an average conservative expansion rate of 9:1, this results in a volume of 9,000 gallons of expanded fire-fighting foam being applied to a design surface area in less than 45 seconds. This equates to a median volumetric flow rate of 1,120 gpm.

Composition Analysis Study

Figure 3A:
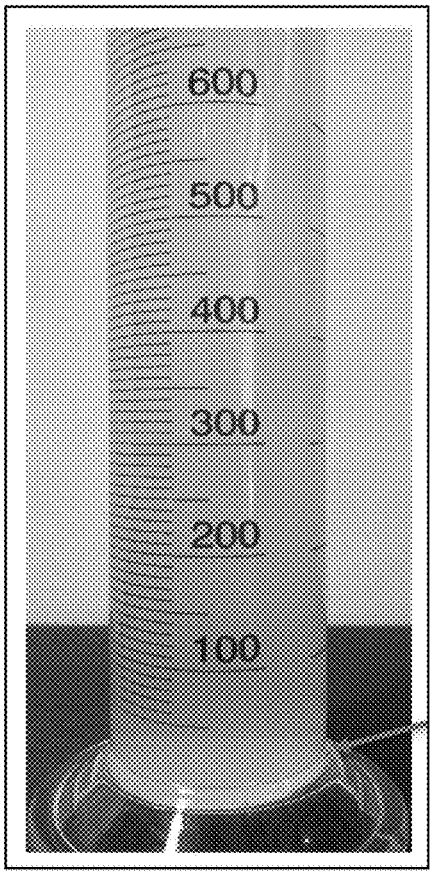
FIG. 3A illustrates perspective partial side view of a sample in a test tube for a conventional fire-fighting foam.

In another study, a 3% self-expanding fire-fighting solution and composition of the disclosure was compared side-by-side with a 3% conventional fire-fighting solution. For this study, both sample solutions were manufactured at the same time and tested for 24 hours. In addition, two identical 1,000 ml laboratory test tubes were used and prepared as follows: The tubes were thoroughly washed with distilled water only and scrubbed removing any type of foreign material; both tubes were air dried before use. Further preparation of the conventional sample included means of weight, and calibration lines on the tubes, 97 ml/97 grams of water was added with 3 ml/3 grams of Ansul 3% AR-AFFF foam agent. A mechanical mixer with a flat rotating type tip was added and the mixture mixed for a period of 1 minute. The tube was closed off and sealed and turned around several times over a period of one (1) minute. The seal was taken off and again mixed for a period of one (1) minute, ensuring a homogeneous light green colored mixture. In addition, 50 ml samples were drawn from both tubes and stored in separate test tubes, for further testing. The importance of this test was to document if indeed there was separation present in the total emulsified composition. FIG. 3A illustrates a 3% composition AR-AFFF of the conventional solution immediately after the sample has been prepared, wherein the mixture is light green in color and wherein it visibly appears that emulsification has taken place between the concentrate and water composition.

Figure 3B:
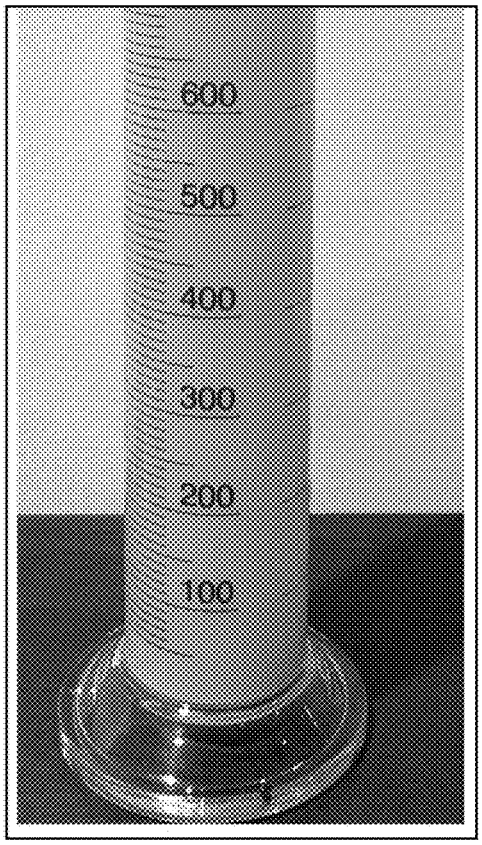
FIG. 3B illustrates a perspective partial side view of a sample for the expandable fire-fighting foam solution of the disclosure described herein.

For the self-expanding fire-fighting foam composition of the disclosure, 1,000 ml of foam was tapped from the test port on of a fire-fighting foam vessel of the disclosure. Here, this was done at a very slow rate to ensure that major expansion does not take place and also to ensure a sample without excessive foaming. Further, no mixing was required as this had been previously performed via the manufacturing process of the disclosure described here. Here, Ansul 3% AR-AFFF foam agent was used in the manufacturing process. Referring to FIG. 3B, the manufactured expandable fire-fighting mixture of the disclosure is darker green in color and it visibly appears that emulsification has taken place between the concentrate and water composition. Further, the inert gas absorption via Henry's Law, has an effect on the discoloration of the mixture of the disclosure. It is noted that there is visible separation between the foam concentrate and water composition and that emulsification was only temporary on the conventional fire-fighting composition, as shown in FIG. 3A. Moreover, the conventional fire-fighting composition sample shows that nearly the entire 3% concentrate or foaming agent has separated from the previous homogeneous emulsified composition as opposed to the expandable fire-fighting composition sample of the disclosure showing that it is nearly or completely 100% emulsified and intact.

Figure 4A:
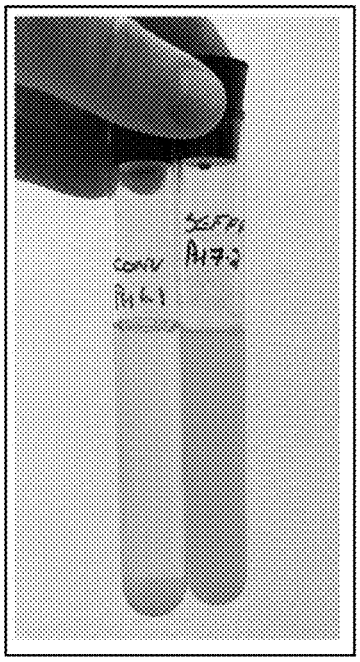
FIG. 4A illustrates a perspective partial side view of the sample comparisons between the conventional fire-fighting foam and the expandable fire-fighting foam of the disclosure described herein.
Figure 4B:
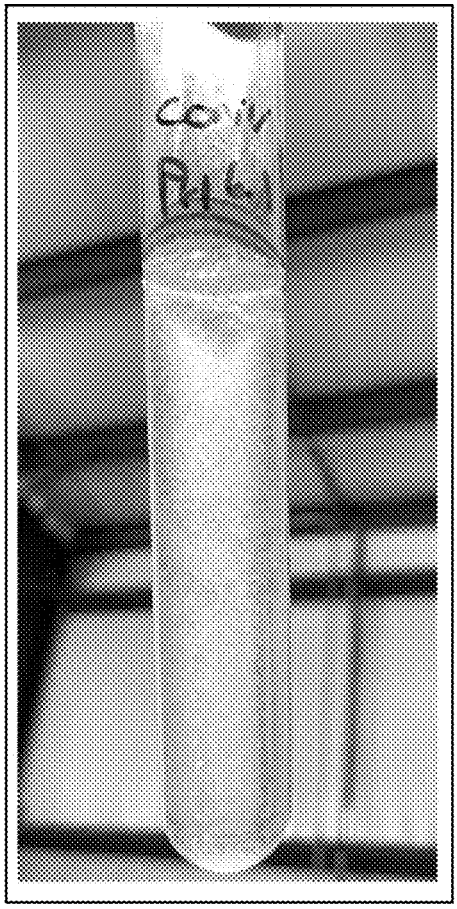
FIG. 4B illustrates a perspective partial side view of the sample comparison of the conventional fire-fighting foam.
Figure 4C:
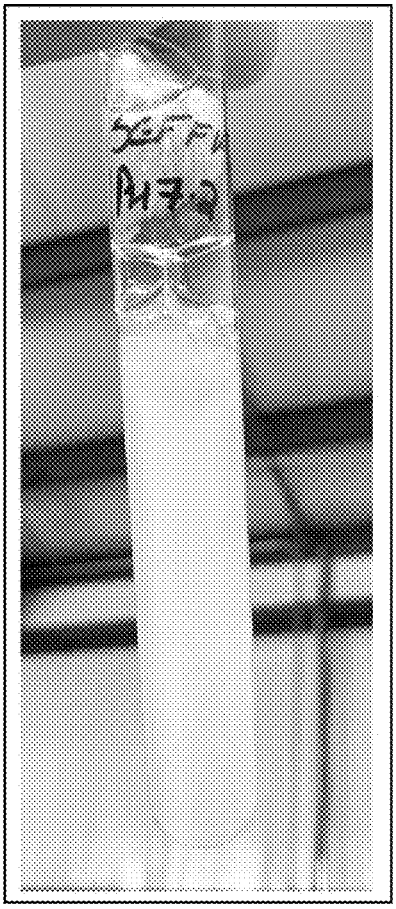
FIG. 4C illustrates a perspective partial side view of the sample comparison of the expandable fire-fighting foam of the disclosure described herein.

FIGS. 4A-4C illustrates a comparison of the two samples after a 24-hour period. Referring to FIGS. 4A-4C, the conventional fire-fighting composition sample is labeled as CONV, whereas the expandable fire-fighting composition of the disclosure is labeled as SEFFF. In particular, after a 24-hour comparison of the samples, a pH value of 6.1 was measured for the conventional solution sample, whereas as pH value of 7.2 was measured for the fire-fighting solution sample of the disclosure. As shown in FIGS. 4A-4C, the conventional sample is shown with a definite lighter composition relative to the fire-fighting composition of the disclosure. For the conventional sample, it is noted that separation is taking place between the water and the foam concentrate due to the weight differences and no molecular binding. However, the fire-fighting composition sample of the disclosure is shown to be substantially or 100% intact and completely homogeneous, thereby demonstrating that the manufacturing process of the disclosure ensures emulsification and molecular binding through the presence of over pressurization in an inert closed environment. Further, the addition of the pH balancing agents and additives can further improve the emulsification and molecular binding of the foam composition of the disclosure.

Figure 5A:
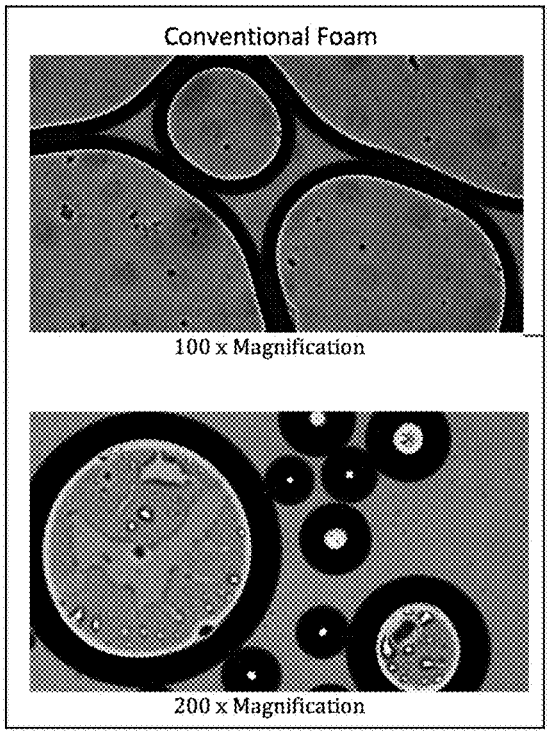
FIG. 5A illustrates top view of microscopic images of the sample of the conventional fire-fighting foam bubbles, shown at 100× magnification and 200× magnification.
Figure 5B:
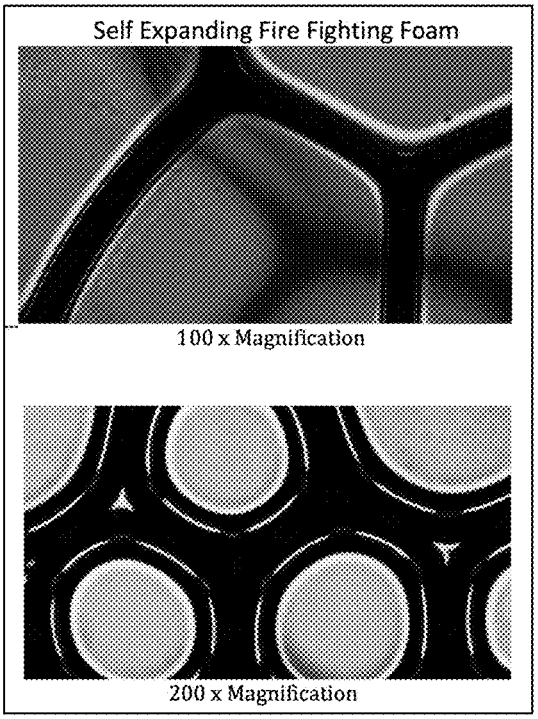
FIG. 5B illustrates top view of microscopic images of the sample of the expandable fire-fighting foam bubbles of the disclosure described herein, shown at 100× magnification and 200× magnification.
Figure 5C:
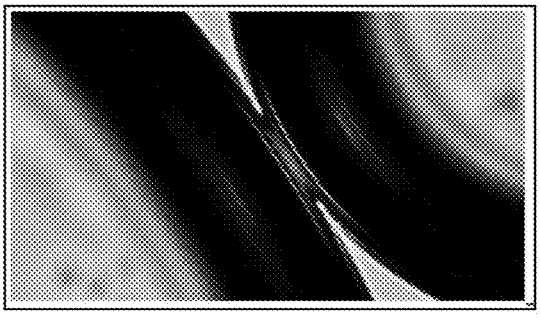
FIG. 5C illustrates a close-up top view of a microscopic image of the sample of the conventional foam bubbles.
Figure 5D:
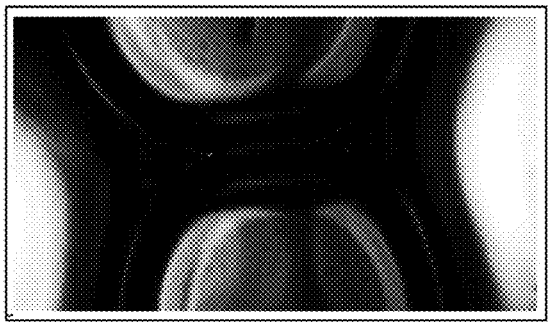
FIG. 5D illustrates a close-up top view of a microscopic image of the sample of the expandable fire-fighting foam bubbles of the disclosure described herein.

FIGS. 5A-5D further illustrate a comparison of the cell structure of the foam bubbles of the conventional fire-fighting composition sample, as shown in FIGS. 5A and 5B relative to the foam bubbles of the expandable fire-fighting composition sample of the disclosure, as shown in FIGS. 5B and 5D. As shown in the figures, it is noted that the wall thickness of the conventional foam bubble appears to be thinner in structure than the fire-fighting composition of the disclosure's bubbles' wall thickness. In addition, there is also visible separation between the bubbles of the conventional fire-fighting composition opposed to the expandable fire-fighting composition bubbles of the disclosure, which are much closer and tighter packed together due to the over pressurization (saturation) during the manufacturing process. For example, as shown in FIG. 5C, the conventional foam sample bubbles appear next to each other with visible gaps in-between them. In contrast, as shown in FIG. 5D, the expandable fires fighting foam composition bubbles of the disclosure are shown closely and tightly packed together with no visible separation between them, which was achieved via the manufacturing method and system of the disclosure described herein.

Having thus described the several embodiments of the present invention, those of skill in the art will readily appreciate that other embodiments may be made and used which fall within the scope of the claims attached hereto. Numerous advantages of the disclosure covered by this document have been set forth in the foregoing description. It will be understood that this disclosure is, in many respects, only illustrative. Changes can be made with respect to various elements described herein without exceeding the scope of the invention. Although the present invention has been described in considerable detail with reference to certain preferred versions or embodiments thereof, other versions and embodiments are possible. Therefore, the spirit and scope of the appended claims should not be limited to the description of the preferred versions contained herein.

What is claimed is:

1. A method of manufacturing a self-expanding fire-fighting foam solution, the method comprising:

pressurizing a pressure vessel with an inert gas, such that the inert gas purges air from the pressure vessel;

dispensing or filling a pre-determined amount of foam concentrate into the pressure vessel;

dispensing or filling a pre-determined amount of water into the pressure vessel; and mixing the foam concentrate and water within the pressure vessel; wherein the mixed foam and water within the pressure vessel provide the self-expanding fire-fighting foam solution.

2. The method of claim 1, wherein the foam concentrate is used at 1-part foam concentrate (1%) to 99-parts water (99%).

3. The method of claim 1, wherein the foam concentrate is used at 3-part foam concentrate (3%) to 97-parts water (97%).

4. The method of claim 1, wherein the foam concentrate is used at 6-part foam concentrate (6%) to 94-parts water (94%).

5. The method of claim 1, further comprising a testing the pH of the mixed foam concentrate and water solution via a test port on the pressure vessel.

6. The method of claim 1, further comprising adding a pH balancing agent or pH additive to the pressure vessel.

7. The method of claim 6, further comprising adding the pH balancing agent or pH additive to the pressure vessel such that a pH value of 6.8 to 7.8 moles per liter is achieved.

8. The method of claim 1, wherein the purging is further comprises pressurizing the pressure vessel with the inert gas to a pressure range of about 250 psig to about 300 psig.

9. The method of claim 1, wherein the mixing is performed via a centrifugal pump.

10. The method of claim 1, wherein the pressure vessel comprises about 20% to 25% volume of inert vapor space.

11. A method of manufacturing a self-expanding fire-fighting foam solution, the method comprising:

pressurizing a pressure vessel with an inert gas, such that the inert gas purges air from the pressure vessel;

dispensing or adding a pre-determined amount of foam concentrate into the pressure vessel;

dispensing or adding a pre-determined amount of water into the pressure vessel;

mixing the foam concentrate and water within the container; and dispensing or adding a pH balancing agent to the mixed foam concentrate and water.

12. The method of claim 11, wherein the foam concentrate is used at 1-part foam concentrate (1%) to 99-parts water (99%).

13. The method of claim 11, wherein the foam concentrate is used at 3-part foam concentrate (3%) to 97-parts water (97%).

14. The method of claim 11, wherein the foam concentrate is used at 6-part foam concentrate (6%) to 94-parts water (94%).

15. The method of claim 11, further comprising dispensing the pH balancing agent or pH additive to the pressure vessel such that a pH value of 6.8 to 7.8 moles per liter of the mixed foam concentrate and water is achieved.

16. The method of claim 11, wherein the pressure vessel is pressurized with the inert gas to a pressure range of about 250 psig to about 300 psig.

17. The method of claim 11, wherein the inert gas is comprised of one or more of: carbon dioxide, nitrogen, helium (He), argon (Ar), neon (Ne), krypton (Kr), xenon (Xe), and radon (Rn), and oganesson (Og).

18. The method of claim 11, wherein the pH balancing agent is comprised of one or more of: acetic acid, Buff-10, caustic potash (potassium hydroxoide, KOH), caustic soda (sodium hydroxide, NaOH), citric acid, hydrochloric acid (HCl), lime (Ca(OH)2), magnesium oxide (MgO), and soda ash (sodium carbonate, Na2CO3).

* * * * *